US005121817A

United States Patent [19]

Garrido et al.

[11] Patent Number: 5,121,817

[45] Date of Patent: Jun. 16, 1992

[54] ROLLER-TRACK SYSTEMS FOR TELESCOPIC DOORS ON ELEVATORS

[75] Inventors: Alfonso Garrido; Juan Martin; Jose Sevilleja, all of Madrid, Spain

[73] Assignee: Otis Elevator Company, Farmington, Conn.

[21] Appl. No.: 555,885

[22] Filed: Jul. 23, 1990

[51] Int. Cl.[5] ..... B66B 13/00

[52] U.S. Cl. ..... 187/56; 49/409; 49/120

[58] Field of Search ..... 187/51, 56, 52 R, 50; 49/120, 116, 453, 409, 404, 420; 160/196.1, 197

[56] References Cited

U.S. PATENT DOCUMENTS

| | | | |
|---|---|---|---|
| 1,966,182 | 7/1934 | McCormick | 187/52 R |
| 3,426,480 | 2/1969 | Dzamba | 187/56 |
| 4,073,034 | 2/1978 | Martens | 16/87 B |

FOREIGN PATENT DOCUMENTS

| | | | |
|---|---|---|---|
| 8186 | 1/1990 | Japan | 187/56 |
| 557978 | 6/1977 | U.S.S.R. | 187/56 |

*Primary Examiner*—Robert P. Olszewski
*Assistant Examiner*—Kenneth Noland
*Attorney, Agent, or Firm*—William W. Jones

[57] ABSTRACT

The device is applicable to elevator telescopic two-speed doors, using either two panels with opening towards one side or else using four panels with opening in the center, the rolling device being foreseen to be mounted on a single track as a sliding guide. The rolling device includes a case which encloses rollers and counter rollers which roll along the track. The case is formed from two parts connected together and to a bracket on the door by a pair of fasteners. The fasteners form the axles of the rollers. The track can be circular in section and the rollers can be linear ball bearings.

4 Claims, 2 Drawing Sheets

ROLLER-TRACK SYSTEMS FOR TELESCOPIC DOORS ON ELEVATORS

TECHNICAL FIELD

The present invention, as is expressed in the title of this specification refers to a rolling device for the sliding of automatic overlapping or telescopic doors used on elevators, doors which hang from respective support brackets to which the corresponding rolling devices themselves are fastened, the latter sliding along adequate tracks. The door system to which this invention applies will include at least two adjacent doors that open by moving in the same direction, and close by moving in the same opposite direction. One door is called the fast door and the other the slow door, the fast door being the one that must move the farthest during the opening and closing operations. As the doors open and close, they telescope or lap over one another.

The invention centers on novelties in the rolling device itself of the elevator automatic telescopic doors, foreseeing as novelty that the group of elements which slide by rolling over the corresponding track are mounted in a box or body which is fastened to the hanging support brackets of the respective door. The rolling or sliding elements are formed by a guide roller which is complemented by a counter-roller, susceptible of being replaced by side rollers or even convex contact surfaces existing on both sides of the track, the rolling elements being likewise formed by linear ball bearings.

BACKGROUND ART

Conventional elevator telescopic two-speed doors use two panels, two tracks, four rollers and four counter-rollers. In the case of a four panel two-speed center opening door, the situation is the same but with double elements.

Now then, this system of two tracks for the sliding of doors has various inconveniences among which the following can be cited:

Accuracy of positioning of both tracks;

Special fastening to the frame of each track;

Higher cost than one single track system;

The tracks normally require special machining and welding and special fasteners;

The rollers and counter-rollers are mounted over hanging supporting shafts with poor stiffness due to space and cost constraints;

Perpendicularity and positioning are very difficult and adjustments are always needed; and These systems lead to jerking and produce distortion on rollers and counter-rollers shafts' perpendicularity.

Though there are a large number of conventional solutions, most existing telescopic doors use two parallel tracks or at best a single profile extruded with two parallel tracks in the same piece.

In any case the unit is very complex, heavy and voluminous, creating problems of misalignment and requiring unstable adjustments and, in general terms, extremely weak connections between the overhanging roller shafts and the hanging support bracket of the door.

Each one of these factors contributes to producing jerks and noise during movement of the door panels, finally giving rise to deterioration of the rollers and even the tracks On the other hand, the door lintel on which the tracks have to be fastened must have flat support points to form exact reference points for the tracks, at least in three points. It is necessary to use separators to fasten and install the two tracks in their position.

In the same way, the rolling parts are not protected against dust and their assembly is very difficult, requiring in general terms an adjustment by means of the eccentric shafts of the upthrust rollers.

All of the above leads to problems of quality, to the need to make adjustments and to over dimensioning, causing a very high cost of manufacturing and obtainment of the system.

DISCLOSURE OF THE INVENTION

This invention utilizes a rolling device by means of which all the above-cited problems are eliminated based on a single track with different possible shapes which permit high-speed panel rolling elements and low-speed panel rolling elements to move over the same track.

On the other hand, the rolling unit can offer different alternatives or embodiments compatible with the type of sole track chosen, and which gives more stiffness to the shafts or supports of the rolling elements.

The elements themselves rolling or sliding over the corresponding track are arranged in a case or body formed by two cups facing each other and fastened to one another by means of threaded transverse pins, which are not only the fastening means of both cups, but also the fastening means of the unit to the hanger support of the door, likewise being used as an assembly means for the elements themselves rolling on the track.

On the other hand, the rolling elements can consist of a roller guided and supported at the top on the track, a roller which is complemented by a bottom counter-roller, or else by some side rollers and even with convex contact surfaces existing on both sides of the track.

Another alternative to the rolling elements consists of them being formed of linear ball bearings mounted on a circular section track.

In order to complement the description which is going to be made and for the purpose of helping to attain a better understanding of the features of the invention, the present specification is accompanied by a set of drawings whose figures will provide an easier understanding of the scope of the invention.

The method of the invention is illustrated hereafter by means of one embodiment with reference to the accompanying drawings, in which:

BEST MODE FOR CARRYING OUT THE INVENTION

Figure 1:
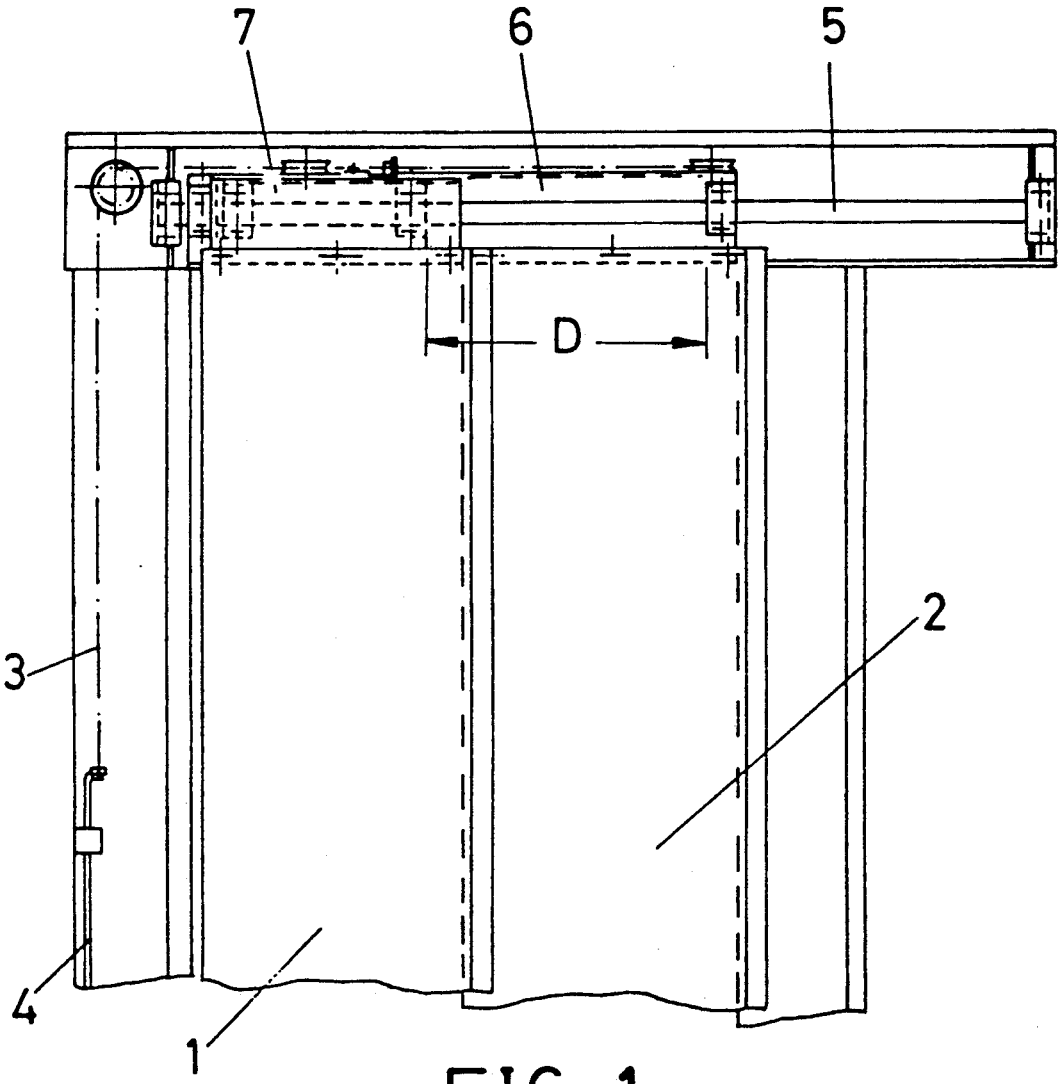
FIG. 1 shows a front view of the top part of the two doors of an elevator hanging from the corresponding hanging supports

As is shown in FIG. 1, the rolling device that the invention proposes is foreseen for use in elevator doors, which in FIG. 1 doors 1 and 2, rapid and slow respectively, connected to the corresponding hauling cable 3 from which a counterweight 4 hangs.

Now then, one of the main objects of the invention is that the sliding track of doors 1 and 2 is made up of a single piece 5, which may have different forms as far as the section is concerned, permitting the rolling elements of the high-speed panel and low-speed panel 2 to slide over the same track 5.

On the other hand, the corresponding hanging support bracket 6 of the slow-speed panel or door 2 is longer than the hanging support bracket 7 of the high-speed panel or door 1, making it possible to leave a free area in the central part of the track 5 to situate said hanging support bracket 7 in it, so that the only condition is that the distance D is longer than half the total free opening of the door.

On the basis of this concept of a sole track 5, all the separators and fastening means which are typical in two-speed doors are eliminated, with the particular feature that said track 5 is only supported by its end parts in a very easy friction device, which completely avoids any mechanization of the same.

Figure 2:
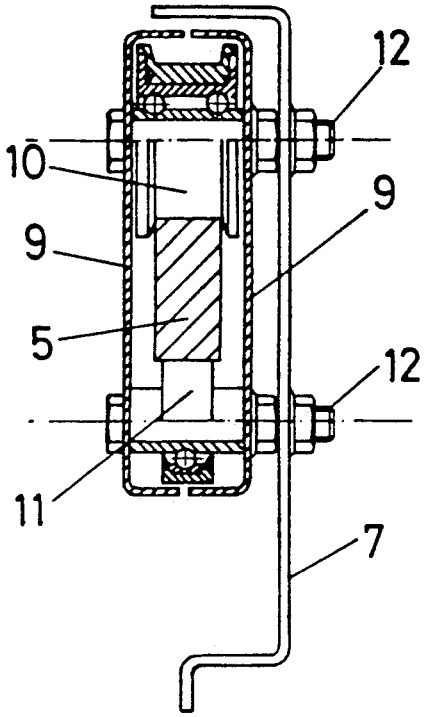
FIGS. 2, 3, 4 and 5 show other embodiments in cross section of the rolling device itself, but maintaining the constant that the track is formed by a single piece lodged, along with the rest of the rolling elements, in a box or body duly fastened to the hanging support of the door.
Figure 3:
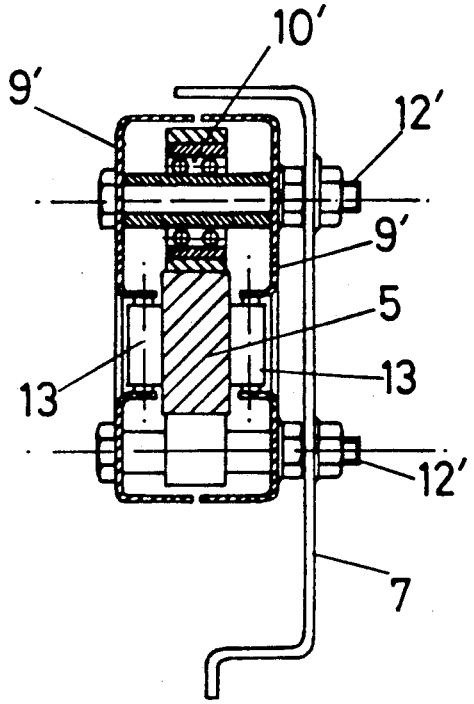
Figure 4:
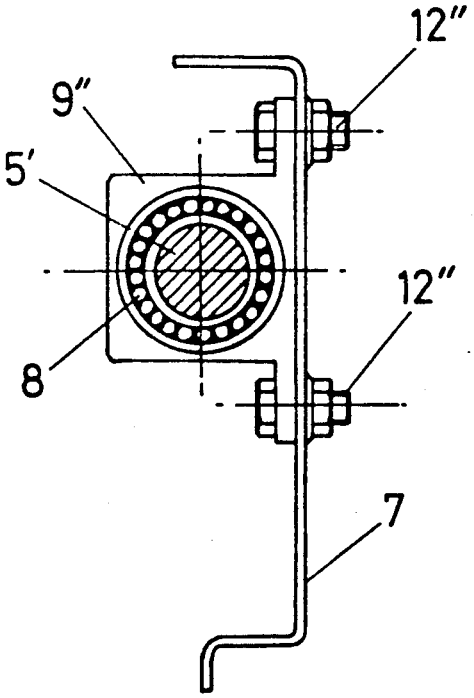
Figure 5:
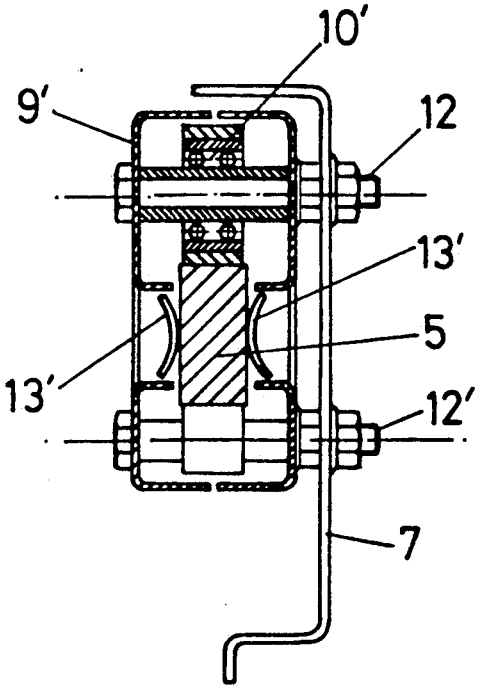

As to the rolling unit itself, and which is the true object of the invention, it may use linear ball bearings 8 for a circular section track 5' shown in FIG. 4, while for the rectangular section tracks 5 shown in FIGS. 2, 3 and 5, three different solutions can be used.

The rectangular section track 5 is specifically shown in FIG. 2, as well as the corresponding hanger support 7 of the door. The rolling unit is made up of a case formed by two halves or cups 9 facing each other, inside of which are the top profiled roller 10 having side flanges 17 which flank the track 5 and provide resistance to lateral movement of the doors on the track 5 that rests on the longitudinal edge of the track 5 and a bottom counter-roller 11 which rests on the longitudinal and bottom edge of the track 5, thus eliminating the traditional overhanging shape, therefore increasing resistance and at the same time avoiding dust, etc., from depositing on the moveable elements.

The two cups or halves 9 which form the case of the rolling unit remain fastened to each other by screws 12 which aside from providing the fastening means for the roller 10 and counter-roller 11, form the fastening means of the unit to the hanging support bracket 7.

An alternative embodiment of the rolling unit is shown in FIG. 3, where the case is formed by the semi-enveloping cases or cups 9' facing each other fastened together and to the hanger support 7 by means of screws 12', eliminating in this case the profiled roller and having some side friction wheels 13, which collaborate in the guiding of the non-profiled roller 10' in its resting and sliding over the top edge of the track 5.

A similar embodiment as the one corresponding to FIG. 3 is shown in FIG. 5, but with the particular feature that in this case the side friction wheels 13 of FIG. 3 have been replaced by some curvo-convex surface pieces 13' which are cheap to manufacture and easy to replace, which offer reduced friction.

In all of the cases the invention has an additional protection for fireproof doors without complicating the structure of the unit.

Finally, and as has been put forth already above, when the track 5' has a circular section as is shown in FIG. 4, the rolling elements are made up of linear ball bearings 8 protected by a case 9'' which likewise fastens to the hanger support 7 by means of corresponding screws 12''.

According to what has been described it is possible to substantially reduce the number of pieces of the door unit, given that it is possible to prepare a special unit with track, rolling units and hanger support, and to assemble all the same directly with the door frame on one side and with the door panels on the other side.

What is claimed is:

1. A telescopic door assembly comprising a pair of doors mounted on a single track, said doors opening in a first direction by telescoping over each other, said doors including rolling means attached thereto for rolling over the track, said rolling means being secured to hanger brackets fastened to the doors, with the hanger bracket on one of the doors being longer than the hanger bracket on the other of said doors; and a casing encapsulating said rolling means, said track extending through said casing.

2. The telescopic door assembly of claim 1 wherein said rolling means comprises a pair of rollers engaging top and bottom surfaces of said track, and further comprising fastener means securing said casing to said hanger bracket and forming axles for said rollers.

3. A telescopic door assembly comprising a pair of doors which telescope over each other when opening and closing, said doors being mounted on and movable over a single track, said doors comprising hanger brackets secured thereto, and roller means secured to the hanger brackets, said roller means providing rolling engagement with the track, each of said roller means being encapsulated in a casing connected to said hanger brackets through which casing said track passes.

4. The telescopic door assembly of claim 3 wherein said casing is formed from a pair of cup-shaped components, and said components are connected together and to said hanger brackets by fastener means which form axles for said roller means.

* * * * *